United States Patent [19]

Buzzard et al.

[11] Patent Number: 5,031,756

[45] Date of Patent: Jul. 16, 1991

[54] KEEPER FOR COMPACT DISC PACKAGE OR THE LIKE

[75] Inventors: Jon D. Buzzard, Deerfield Beach; Thang T. Nguyen, Boca Raton; James M. Keil, Tamarac, all of Fla.

[73] Assignee: Sensormatic Electronics Corporation, Deerfield Beach, Fla.

[21] Appl. No.: 522,244

[22] Filed: May 11, 1990

[51] Int. Cl.[5] ..... B65D 85/57

[52] U.S. Cl. ..... 206/1.5; 53/420; 81/347; 206/309; 206/807

[58] Field of Search ..... 53/409, 410, 416, 420, 53/449; 81/349, 355-363, 424, 424.5, 487, 488; 206/1.5, 307, 309, 387, 444, 807

[56] References Cited

U.S. PATENT DOCUMENTS

| | | | |
|---|---|---|---|
| 2,715,345 | 8/1955 | Rozmus | 81/354 |
| 3,587,837 | 6/1971 | Smith et al. | 206/45.14 |
| 3,933,240 | 1/1976 | Humble | 206/1.5 |
| 3,995,900 | 12/1976 | Humble et al. | 292/316 |
| 4,361,233 | 11/1982 | Holkestad | 206/387 |
| 4,714,161 | 12/1987 | Thorud | 206/807 |
| 4,760,914 | 8/1988 | Gelardi | 206/807 |
| 4,805,769 | 2/1989 | Soltis et al. | 206/309 |
| 4,819,797 | 4/1989 | Holmgren | 206/309 |
| 4,834,238 | 5/1989 | Hehn et al. | 206/387 |
| 4,871,065 | 10/1989 | Hehn et al. | 206/807 |

FOREIGN PATENT DOCUMENTS

| | | | |
|---|---|---|---|
| 0098216 | 1/1984 | European Pat. Off. | 206/807 |
| 0359433 | 9/1922 | Fed. Rep. of Germany | 81/424.5 |
| 2112753 | 7/1983 | United Kingdom . | |

*Primary Examiner*—Jimmy G. Foster

*Attorney, Agent, or Firm*—Robin, Blecker, Daley & Driscoll

[57] ABSTRACT

A keeper for a package containing an article in which a frame is provided with an opening for receiving the package and a slender, rod-like piercing means is supported on the frame to move between a first position wherein the piercing means is outside the frame volume and a second position wherein the piercing means is within the frame volume and able to pierce and engage the package when previously introduced in the frame.

75 Claims, 7 Drawing Sheets

Bump- Deforms outer packaging and forces inner merchandise under the piercing means.

Compensates for manufacturing variances in outer packaging.

KEEPER FOR COMPACT DISC PACKAGE OR THE LIKE

BACKGROUND OF THE INVENTION

This invention relates to a holder or keeper for an article and, in particular, to a keeper which is adapted to prevent unauthorized removal or theft of the article.

In many environments where small, valuable articles are displayed for sale, keepers have been developed for the articles as a means for making theft of the articles more difficult. Keepers of this type may take on a variety of forms. In one form, the keeper is designed to be locked to the article. Unless the keeper is removed by a special key or detaching device, which is used at the time the article is paid for, the presence of the keeper renders the article useless.

U.S. Pat. No. 4,819,797 discloses a keeper of this type adapted for use with compact discs and tape cassettes. The keeper of the '797 patent is specifically designed to be locked directly to the hinged box (the so-called "jewel box") containing the compact disc or tape cassette. This is accomplished by using a U-shaped latch element configured to engage an already existing aperture in the jewel box.

More particularly, in the unlocked position, the U-shaped latch element is held by the frame of the keeper so as to be outside the volume of the frame receiving the jewel box. In the locked position, the U-shaped latch element extends into this volume and enters and engages the aforementioned aperture in the jewel box. The latch element thereby locks the jewel box to the frame.

The '797 patent mentions that the transverse edges of the legs of the U-shaped latch element may be made sharp to cut through any plastic film or cellophane wrapping enclosing the jewel box. The patent also mentions that the keeper can be provided with some type of marker adapted to activate a sensing system, in order to detect any attempts to remove the keeper from the premises.

Because of the manner of construction of the keeper of the '797 patent, its use has been confined to compact discs and cassettes whose jewel boxes have existing apertures and either have no outer wrapping or an outer wrapping of plastic film or cellophane. Thus, the '797 patent keeper cannot be used where the articles to be protected are packaged within sturdier outer packaging, such as, for example, the elongated cardboard, paperboard or fiberboard boxes used to package many compact discs.

Other keepers have been proposed for use with such sturdier packaging. U.S. Pat. Nos. 4,805,769 and 4,834,238 disclose two keepers of this type. The keepers of these patents, however, require complicated mechanical locking arrangements, which tend to detract from their usefulness.

It is, therefore, an object of the present invention to provide a keeper for an article which is of relatively simple construction and easy to use with sturdy types of outer packaging.

It is a further object of the present invention to provide a keeper for an article contained in an outer package which permits positive locking of the keeper to the outer package.

It is a further object of the present invention to provide a keeper for an article in which locking and unlocking of the article to the keeper is verified to the user.

It is yet a further object of the present invention to provide a keeper for an article having a paperboard, fiberboard, cardboard or the like outer packaging.

It is a further object of the present invention to provide a detaching device for unlocking or releasing a keeper from an article.

SUMMARY OF THE INVENTION

In accordance with the principles of the present invention, the above and other objectives are realized in a keeper comprised of a frame which defines a volume for receiving an outer package containing an article. A slender rod-like piercing means is supported on the frame for movement between a first position in which the piercing means is outside the frame volume and a second position in which the piercing means is within the frame volume. By moving the piercing means from its first position to its second position after the outer package has been introduced into the frame, the piercing means is caused to pierce into and engage the package, thereby holding the frame to the package.

In the embodiment of the invention to be disclosed hereinafter, the frame comprises opposing front and back wall sections, opposing side wall sections connecting the lateral edges of the front and back wall sections, a bottom wall section connecting the bottom edges of the front, back and side wall sections and an opening opposing the bottom wall through which the outer package can be introduced into the frame. The piercing means, in turn, is configured so as to lock in its second position, whereby a special detaching device is required to return it to its first or unlocked position The piercing means is further adapted to extend into the frame volume above the article and in blocking relationship to the article with respect to movement of the outer package out of the frame.

In further aspects of the invention, a number of detaching devices are disclosed for detaching the frame from the outer package.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
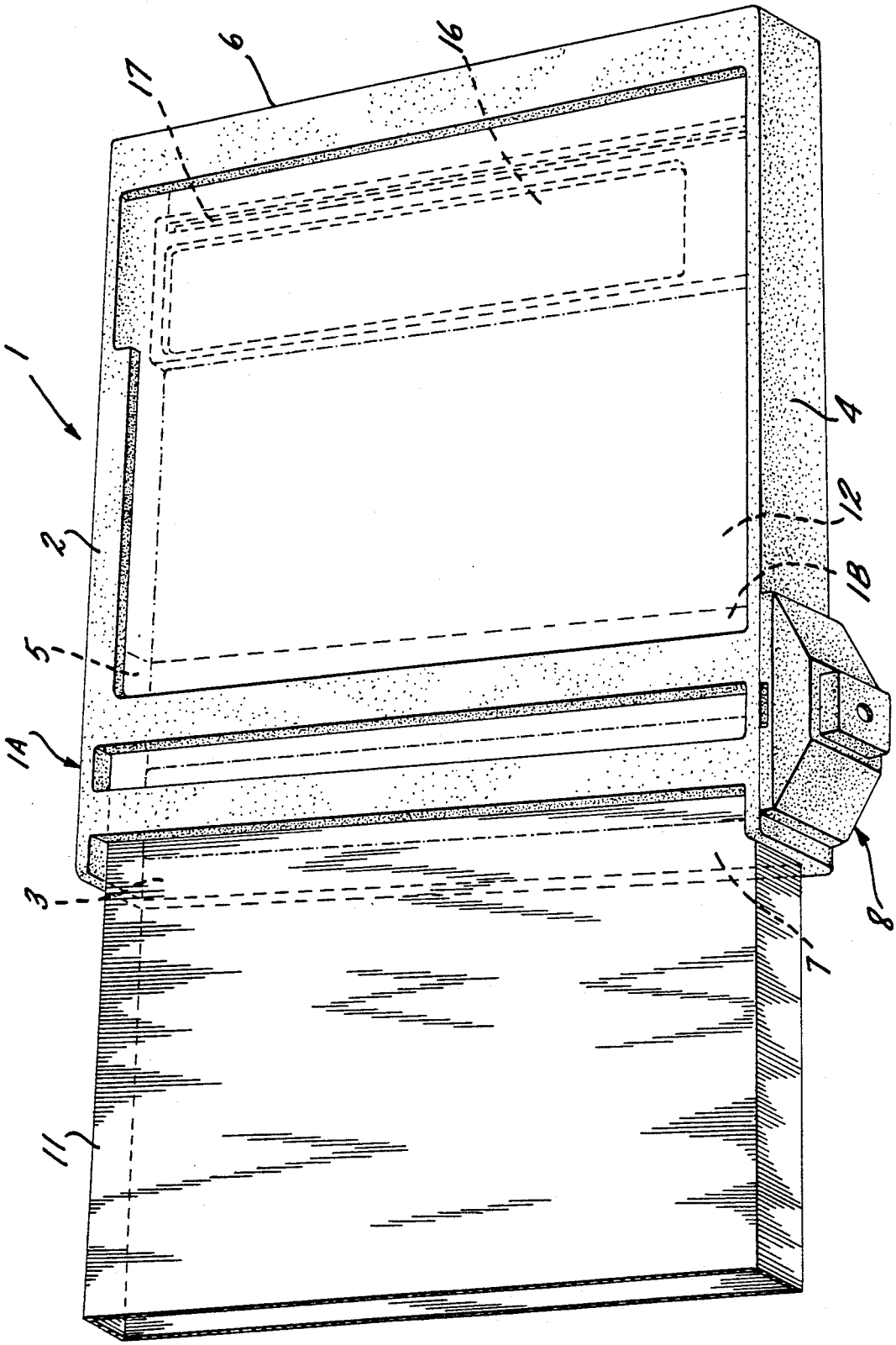
FIG. 1 illustrates an isometric view of a keeper in accordance with the principles of the present invention.

FIG. 1 shows a keeper 1 in accordance with the principles of the present invention. The keeper 1 comprises opposing front and back wall sections 2 and 3 which have open areas for viewing into the keeper. The lateral edges of the front and back wall sections 2 and 3 are joined by side wall sections 4 and 5. A bottom wall section 6 joins the lower edges of each of these wall sections.

The walls sections 2-6 together define a frame 1A which has an opening 7 opposing the bottom wall 6. The opening 7 allows an outer package 11 containing an article 12 to b introduced into the volume 1B defined by the frame. In the present illustrative example, the outer package 11 is assumed to be a usual cardboard, fiberboard, paperboard or the like elongated box containing a jewel box which itself houses a compact disc (not shown), the jewel box and housed disc combinedly forming the article 12. As shown, the outer package 11 at its lower end abuts the bottom wall section 6 of the frame 1, while its upper end extends for some distance beyond the frame volume 1B through the opening 7.

The keeper 1 is further adapted to lock the outer package 11 to the frame 1A by including in the keeper a spring clamp piercing assembly 8. The assembly 8 is mounted on the side wall section 4 of the frame 1 and is configured to include a slender, rod-like piercing member which can be moved between first and second positions in the frame. In the first position, the piercing member is withdrawn from the frame volume 1B and and in the second position the member is within the frame volume.

With the piercing member in the first position, the outer package 11 can be introduced through the opening 7 into the volume 1B in unobstructed fashion. Thereafter, the piercing member can be moved to its second position in which it enters the volume 1B, thereby piercing and engaging the outer package 11 and locking the package to the frame.

FIGS. 2-7 illustrate in greater detail the spring clamp piercing assembly 8 of the keeper 1 of FIG. 1. As shown, the piercing assembly 8 comprises a domed housing part 21 which, in the present case, is integrally formed with the side wall section 4 of the frame. A button shaped member 22 is slidably mounted in a central opening 21A in the housing part 21 and includes a ledge or rim 22A which abuts an area 21E of the inner surface 21D of housing part 21. The latter area 21E borders the opening 21A and prevents withdrawal of the button 22 from the housing. A slender, elonged rod-like pin or tack 23 is carried by the button 22 for movement therewith and is aligned with an aperture 4A in the side wall section 4.

A spring clamp 24 is situated between the wall section 4 and the button 22. Peripheral regions 24B and 24C of clamp body 24A are secured in indented regions 21B and 21C of the housing part 21. The spring clamp 24 is provided with jaw members 24D and 24E which protrude outwardly of the clamp body 24A in the direction of wall section 4 and then toward each other in opposing relationship. The forward, pointed end 23A of the pin 23 passes through the jaws 24D and 24E and depending upon the forces on the clamp body 24A and/or the jaws 24D and 24E themselves, the pointed end 23A is either gripped by the jaws and held or allowed to move freely therethrough.

As supported in the housing part 21, the spring clamp body 24A is bowed away from, i.e., is concave relative to, the wall section 4. This biases the jaws 24D and 24E in gripping relationship to the pin 23. The spring clamp 24 may be of the type disclosed is U.S. Pat. No. 3,995,900, assigned to the same assignee hereof, and the teachings of which are incorporated herein by reference A conical spring 25 of increasing diameter in the direction of the side wall section 4 encircles the pin 23 and extends between the spring clamp body 24A and the bottom surface 22B of the button 22. The conical spring 25 biases the button 22 so that with no external forces applied to the button, it is forced to its outward position with its rim 22A abutting the area 21E of the inner surface 21D of the housing 21.

Figure 3:
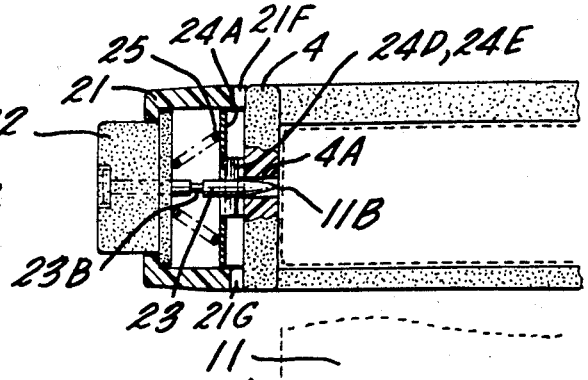
FIGS. 3–4 show frontal and top views of the exploded view of the keeper section depicted in FIG. 2.
Figure 4:
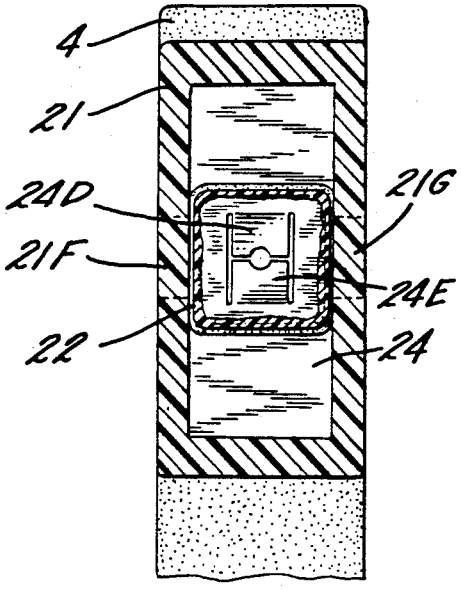
Figure 2:
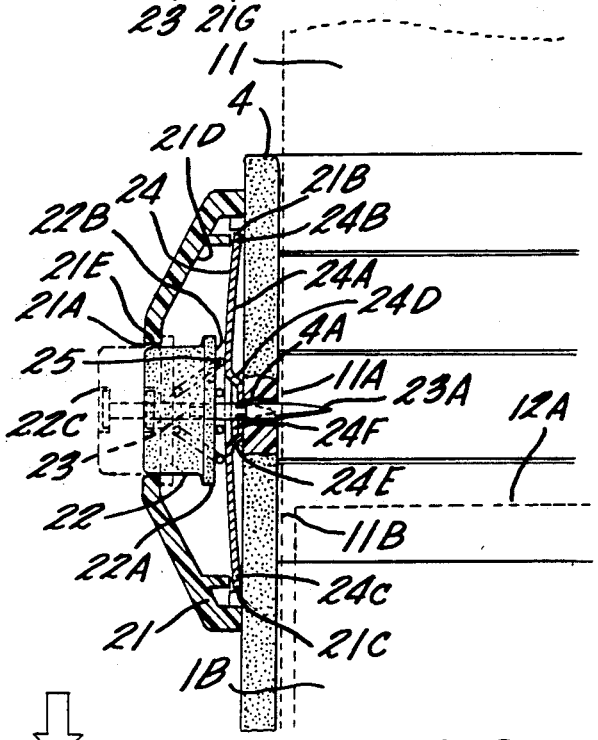
FIG. 2 shows pictorally an exploded view of a portion of the keeper of FIG. 1 depicting the details of the spring clamp piercing assembly of the keeper.
Figure 5:
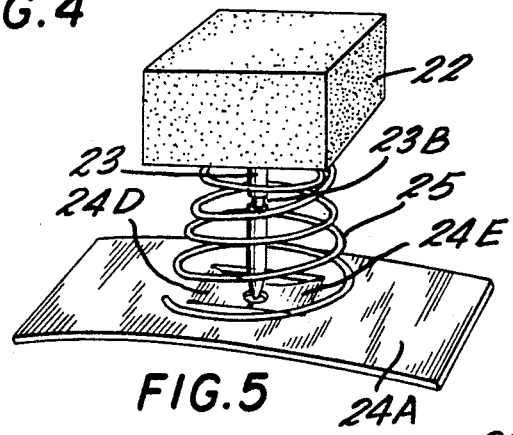
FIGS. 5–7 show pictorally the operation of the spring clamp piercing assembly of FIGS. 2–4.
Figure 7:
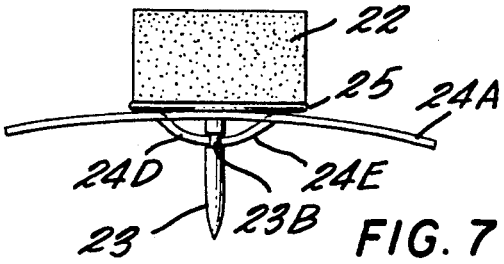
Figure 6:
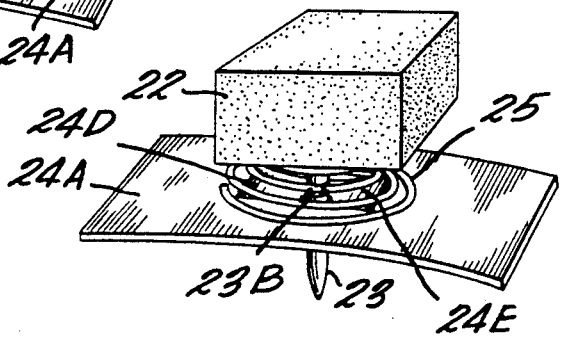

This outward position of the button 22 is shown in dotted line in FIG. 2 and in solid line in FIG. 3. In this position of the button, the forward end 23A of the pin 23 is withdrawn from the volume 1B of the frame 1, as is also shown in dotted line in FIG. 2 and solid line in FIG. 3, and resides in the aperture 4A in the side wall section 4. This corresponds to the above-mentioned first position of spring clamp piercing assembly 8 and is also schematically illustrated in FIG. 5.

When an external force is applied to the top surface 22C of the button 22 in the direction of the side wall section 4, as by pushing with one's finger, the conical spring 25 is caused to collapse within itself against the clamp body 24A. During this time, jaws 24D and 24E of the clamp 24, which, as above-indicated, are normally biased to grip the pin 23 as a result of the concave mounting of the clamp body 24A, are forced open. This releases the grip of the jaws on the pin 23, allowing the pin to move inwardly into the frame volume 1B. The force of this inward movement causes pointed, forward end 23A of the pin to pierce entirely through the outer wall 11B of the outer package 11, creating an aperture 11A which is now engaged by the rod-like body of the pin to thereby hold the outer package.

When the button 22 has travelled its full inward extent, the top surface 22C of the button 22 is flush with the outer most end of the opening 21A of housing part 21. At this time, the conical spring 25 has totally collapsed within itself to one spring thickness and the bias created by the spring clamp body 24A again causes the jaws 24D and 24E to grip and hold the pin 23.

This holding is facilitated by a groove 23B in the rod-like body of the pin, which groove is engaged by the jaws at this inward position of the pin. The pin 23 and button 22 thus become locked. This locked position corresponds to the second position of the spring clamp piercing assembly 8 discussed above and is illustrated in solid line in FIG. 2 and schematically in FIGS. 6-7.

As can be appreciated, locking of the pin 23 in the inward position, simultaneously causes the engagement between the pin 23 and outer package 11 to also become locked. As a result, the frame 1A becomes locked to the outer package 11 and the outer package can no longer be removed from the frame 1A, unless the pin 23 is unlocked and allowed to return to its first position wherein it is again withdrawn from the volume 1B.

The aforesaid unlocking of the pin 23 is realized in accordance with the invention by adapting the spring clamp piercing assembly 8 to allow entry of a detaching assembly adapted to spread the jaws 24D and 24E apart. By spreading the jaws 24D and 24E sufficiently apart, the grip of the jaws on the pin 23 is released, thereby allowing the compressed conical spring 25 to now expand. This pushes the button 22 and pin 23 outwardly, until the rim 22A on the button again contacts the area 21E of the surface 21D bordering the opening 21A. The button 22 and pin 23, thus, return to their original positions, with the pointed, forward end 23A of the pin withdrawn from the volume 1B and within the aperture 4A. As a result, the aperture 11A of the outer package 11 is released from its engagement with the body of pin 23 and the package 11 can now be withdrawn from frame 1A through opening 7.

Figure 8:
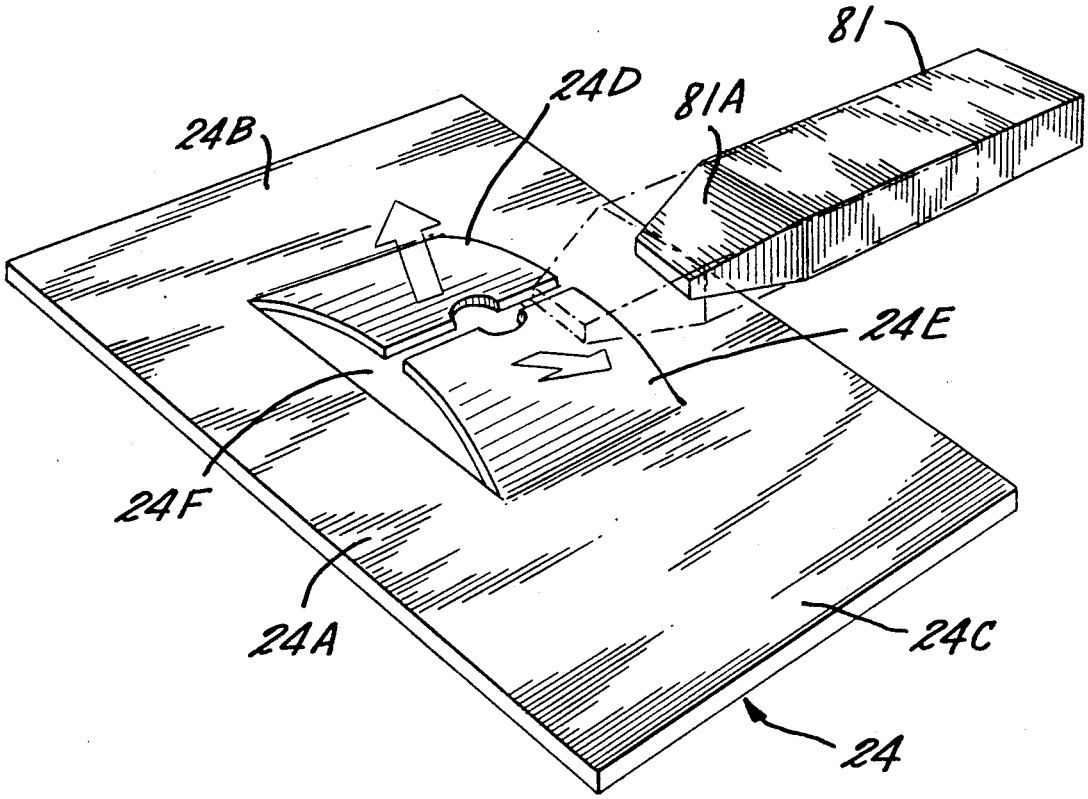
FIG. 8 illustrates pictorally the operation of the detaching assembly for the keeper of FIG. 1.

The spring clamp piercing assembly 8 is adapted to allow entry of a detaching assembly by providing two opposing slots 21F and 21G in the periphery of the housing part 21 and in facing relationship to the space 24F between the jaws 24D and 24E and the clamp body 24A. These slots allow for entry of flat, finger like detaching elements, one of which 81 is shown in FIG. 8. The finger elements 81 have ramped forward ends 81A which enter the space 24F, flexing the jaws 24D and 24E and spreading them apart. This allows free movement of the pin 23 as above-described.

It should be noted that the spring clamp piercing assembly 8 is further adapted to report to the user that the piercing assembly, i.e., the button 22 and pin 23, have reached their first (unlocked) and second (locked) positions. This is accomplished by designing the assembly 8 such that the conical spring 25 returns the button 22 to its outward most position with sufficient force that a sound or click can be heard by the user when the button 22 engages the area 21E of the inner housing surface 21D. Similarly, when the button 22 is pushed to its inner most position, the assembly 8 is designed such that the force of the spring body 24A in closing the jaws 24D and 24E to grip the groove 23B in the pin 23 is sufficient to cause a sound or click. Thus, the assembly 8 provides an audible report to the user, making it easier for the user to know when the assembly has reached its first and second positions.

Also, the assembly 8 is further designed to provide an added mechanism which helps maintain the outer package 11 and its article 12 locked to the frame 1A. This is achieved by adapting the assembly 8 such that, in the locked position, the pin 23 extends into the volume 1B so as to be in blocking relationship to the article 12 with respect to the path of withdrawal of the package 11 from the frame. This is illustrated in FIG. 2, wherein it can be seen that, in the second or locked position of pin 23, the forward end 23A of the pin resides in blocking relationship to the trailing edge 12A of the article 12. Accordingly, with such an arrangement, even if the part of the package 11 around and above the aperture 11A created by the pin 23 were destroyed, thereby destroying the engagement between the pin 23 and package, attempts at withdrawing the remaining portion of the package 11 with the article 12 therein, would be prevented by the blocking engagement of the article 12 with the pin 23. Backup security for locking the frame 1A to the package 11 is thus provided in a simple and easy manner.

In order to ensure that in the locked position of assembly 8, the forward end 23A of the pin 23 is in blocking relationship with the trailing edge 12A of the article 12, a projection 5A may be provided on the inner surface of the side wall section 5 for urging the adjacent wall 11A of the outer package 11 and, therefore, article 12 toward the side wall section 4. This is illustrated in detail in FIGS. 17 and 18 wherein the projection 5A is shown as situated on the wall section 5 substantially opposite the pin 23.

Figure 17:
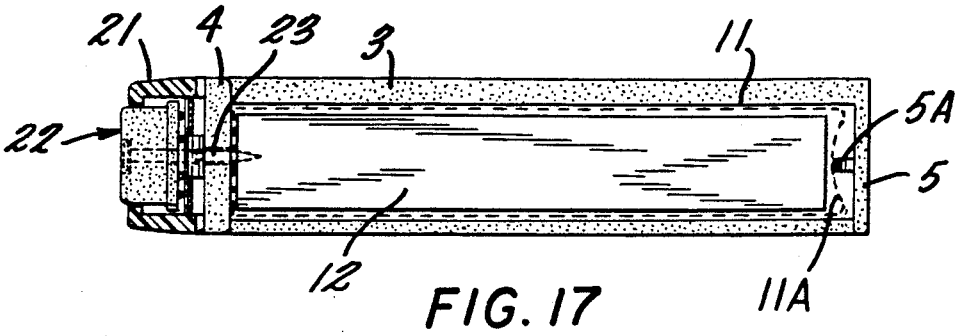
FIGS. 17–18 illustrate a modification of the keeper of FIG. 1.
Figure 18:
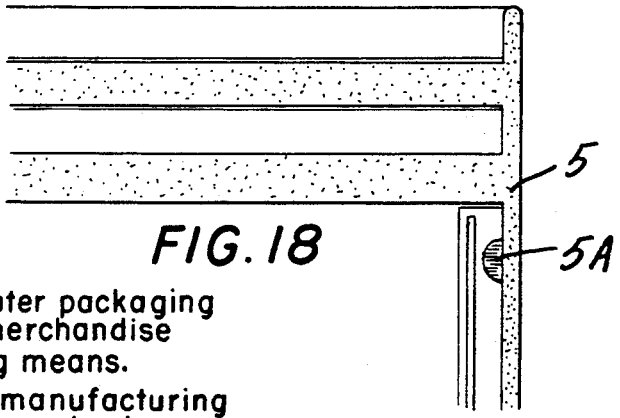

As illustrated, the projection 5A is a thin member with a rounded top for engaging the adjacent side wall 11A of the package 11. This pushes the wall inwardly as best seen in FIG. 17, causing the article 12 to be similarly pushed and reside under the forward end 23A of the pin 23. By using the projection 5A, any variances in the manufacturing tolerances of the package 11 and in any interior packaging holding the article 12 are compensated for and the desired blocking relation of the pin and article are achieved.

Figure 9:
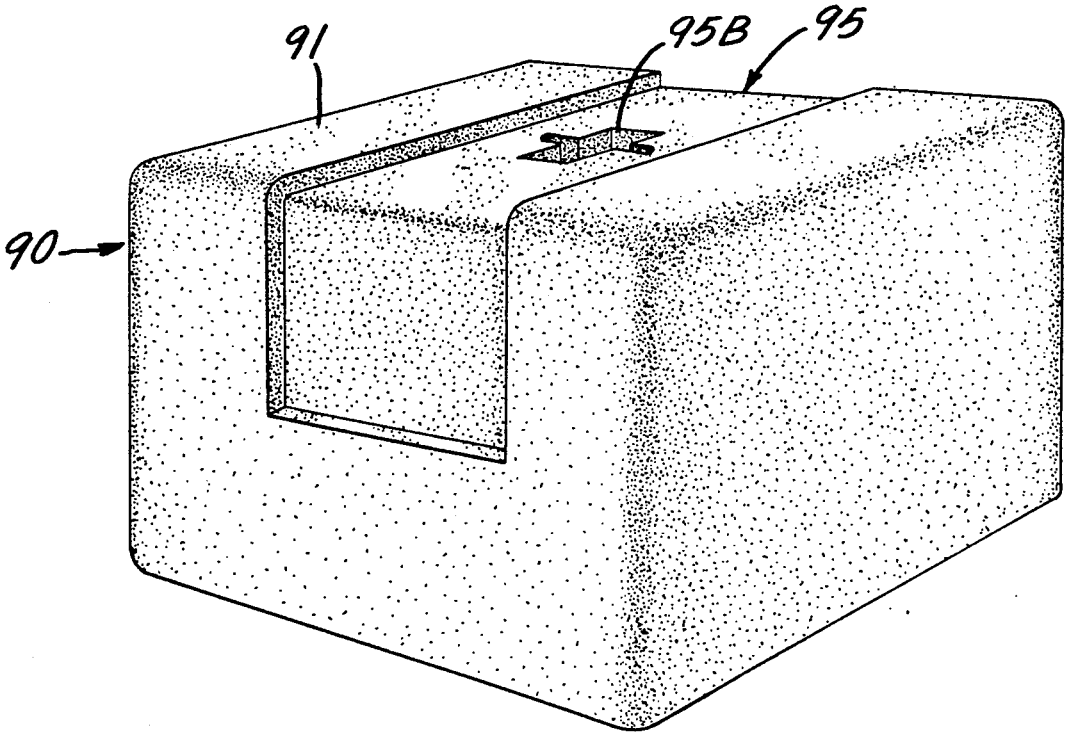
FIGS. 9–10 show isometric and cross-sectional views of a detaching assembly usable with the keeper of FIG. 1.
Figure 10:
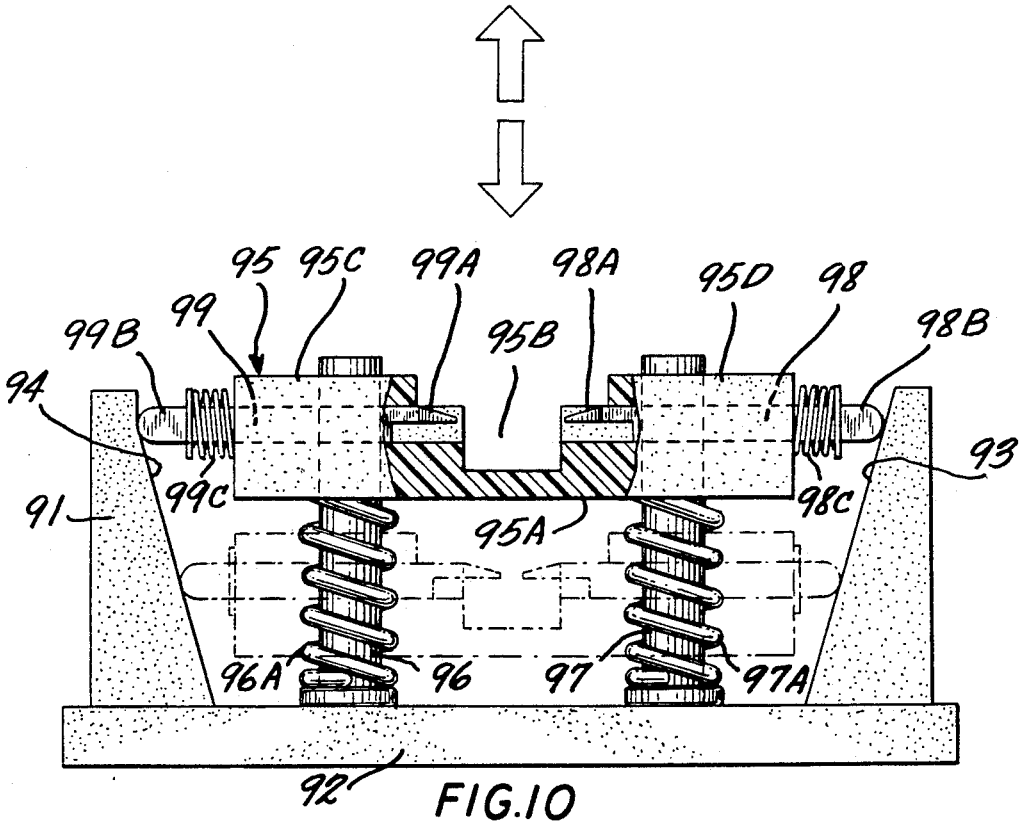

FIGS. 9–10 show a detaching assembly 90 which can be used with the keeper 1 of FIG. 1 to unlock or detach the frame 1A of the keeper from the outer package 11 in the manner described in connection with FIG. 8. The detaching assembly 90 comprises an outer housing having a first housing part 91 and a second housing part or yoke 95. The yoke 95 is situated partially within the housing part 91 and is downwardly translatable relative thereto. Laterally spaced ramped walls 93 and 94 are provided interiorly of the housing part 91 and extend upwardly from a base 92. The walls 93 and 94 are ramped away from each other, i.e., outwardly.

The yoke 95 is situated between the ramped walls 93 and 94, and is slidably mounted on two cylindrical mounting bars 96 and 97. The bars 96 and 97 extend upwardly from the base 92 and a spring 97A is mounted in surrounding relationship to the bar 97. The spring 97A extends between the yoke bottom surface 95A and the base 92, biasing the yoke toward the upper ends of the walls 93 and 94.

The yoke 95 has a central recess 95B bordered on each side by mounting sections 95C and 95D. The mounting sections 95C and 95D support respective elongated, opposing horizontally disposed probes 98 and 99. The probes 98 and 99 are each mounted in their respective sections 95C and 95D to translate horizontally and the forward ends of the probes are formed as flat, ramped fingers 98A and 99A which face the central recess 95B. The back ends 98B and 99B of the probes abut and ride against the ramped walls 93 and 94. Springs 98C and 99C surround the probe ends and bias them against their respective ramped walls.

In using the detaching assembly 91, the frame 1A is placed with the housing part 21 in the central recess 95B and such that the slots 21F and 21G are in facing relationship to the fingers 98A and 99A. The yoke 95 is then moved downwardly with the frame 1A retained in position As the yoke is lowered, the ramped walls 93 and 94 cause translation of the probes 98 and 99 horizontally inwardly toward the central recess 95B, causing the fingers 98A and 99A to enter the slots 21F and 21G.

As the yoke 95 continues its downward movement, the fingers 98A and 99A continue moving horizontally inwardly until they enter the space 24F between the jaws 24D and 24E and spread the jaws apart. As above-described, this releases the pin 23, causing unlocking of the frame 1A from the outer package 11 and allowing removal of the package from the frame. The frame 1A is then removed from the detaching assembly 90 and the yoke 95 returned to its original upward position, placing the assembly 90 in ready position for detaching further frames.

Figure 12:
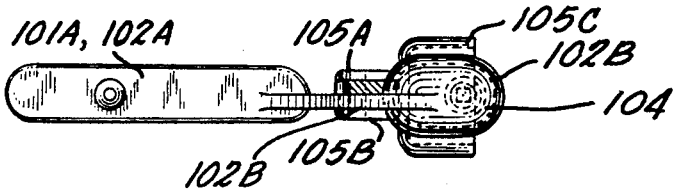
FIGS. 11–13 show Various views Of a further detaching assembly usable with the keeper of FIG. 1.
Figure 11:
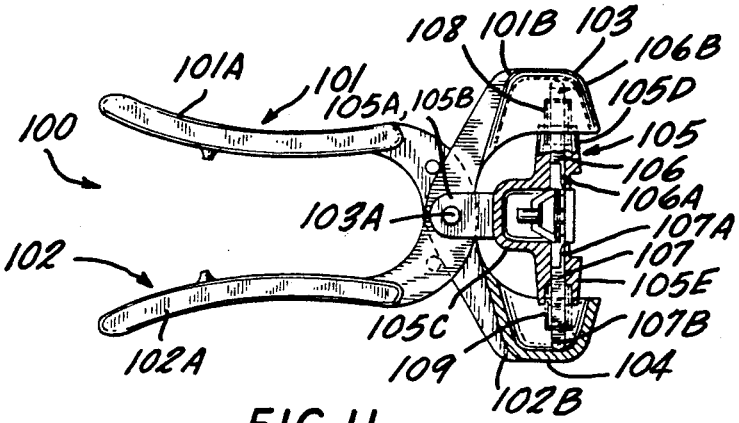
Figure 13:
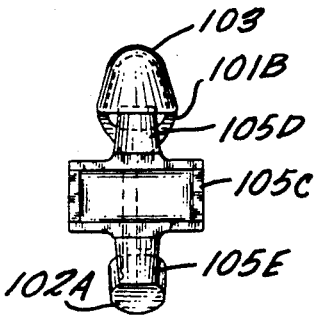
Figure 14:
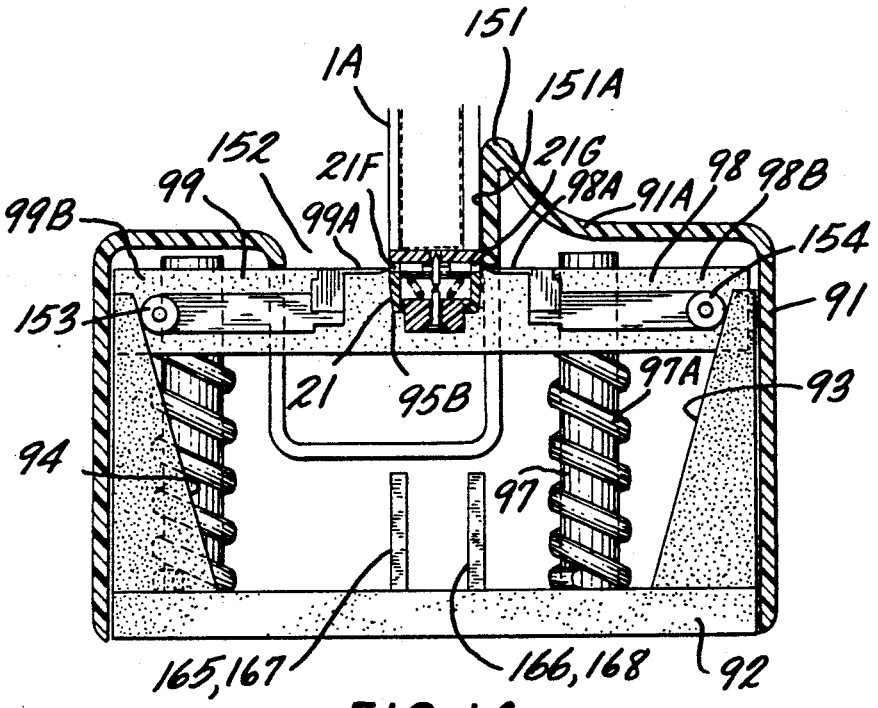
FIGS. 14A and 14–16 show a modification of the detaching assembly of FIGS. 9–10.
Figure 14A:
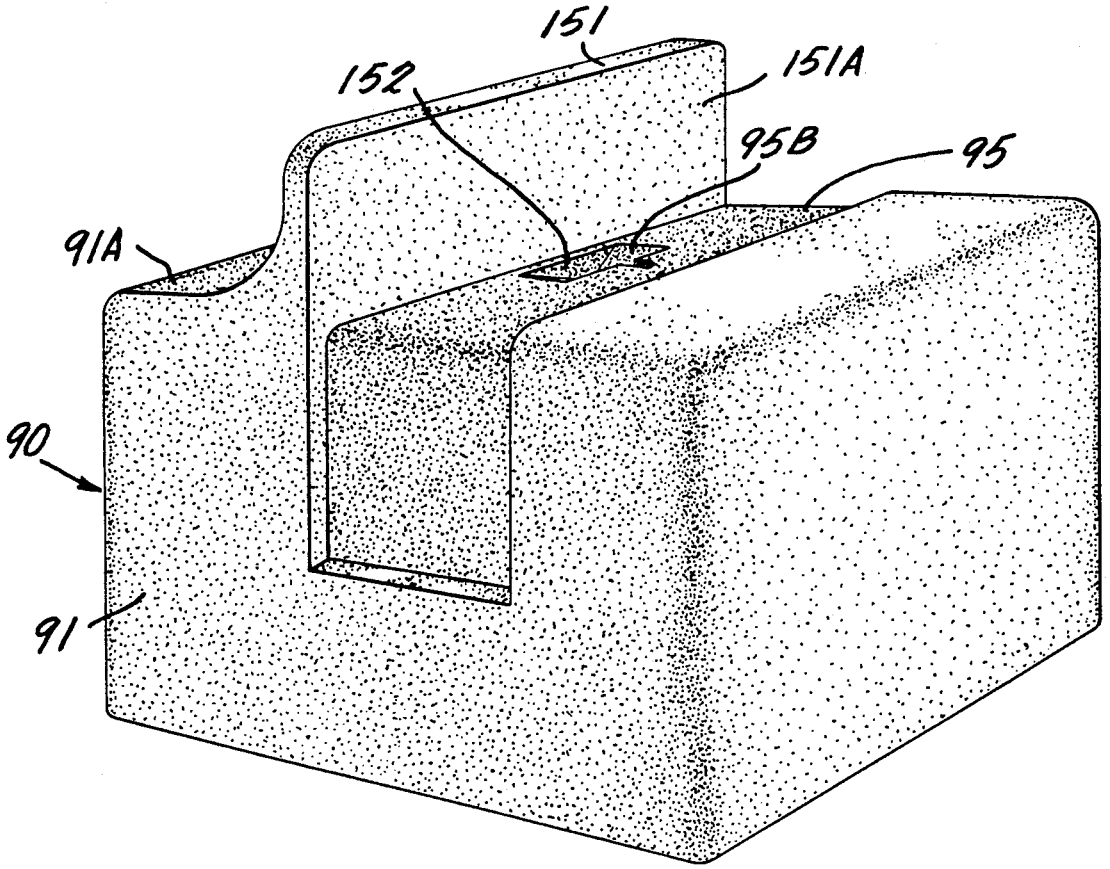

FIGS. 11–13 illustrate views of a further detaching assembly 100 usable with the keeper 1. This assembly is in the form of a plyer-like structure having two members or arms 101 and 102 which are pivotally attached and cross at a common pivot point 103A. The arms 101 and 102 have lower flat, handle portions or sections 101A and 102A and upper opposing cup shaped portions or sections 101B and 102B whose interior surfaces 103 and 104 face one another and are formed as curved camming surfaces.

A yoke member 105 is fixedly mounted to the pivot point 103A via flat upstanding supports 105A and 105B which are attached to the pivot point at the outer surfaces of the arms 101 and 102. The supports 105A and 105B hold at their upper ends, a box-like hollow housing 105C having an open top and extending centrally of the cup shaped portions 101B and 102B. Attached to sides of the housing 105C in facing relationship to the cups 101B and 102B are tubular, horizontally mounted support sections 105D and 105E which open into the housing. The tubular sections 105D and 105E carry probes 106 and 107 which are horizontally translatable. The forward ends 106A and 107A of the probes are formed as flat, ramped fingers and the back ends 106B and 107B of the probes are rounded and extend out of the housings to engage respective camming surfaces 103 and 104. Springs 108 and 109 surround the ends 106B and 107B and maintain the ends against the latter camming surfaces.

When the assembly 100 is used to detach the frame 1A of keeper 1 from the package 11, the housing part 21 of the frame is first inserted into the box-like housing 105C with the slots 21F and 21G of the housing in facing relationship to the tubular sections 105D and 105E carrying the probes 108 and 109. The handles 101A and 102A are then squeezed causing the cup members 101B and 102B to move inwardly and upwardly. This movement results in the camming surfaces 103 and 104 being moved along the probe ends 106B and 107B. As a result, the fingers 106A and 107A of the probes are moved horizontally inwardly into the slots 21F and 21G of frame housing part 21.

Continued squeezing causes the fingers 106A and 107A to enter the space 24F between jaws 24D and 24E of the spring clamp and to force the jaws open. This releases the pin 23, allowing the spring 25 to retract the pin from the volume lB, thereby releasing the package as above-described.

FIGS. 14A and 14–16 show a modified embodiment of the detaching assembly 90 of FIGS. 9–10. In this modified embodiment, the top wall 91A of housing part 91 is provided with an upstanding wall section 151 situated at the edge of the opening 152 which is adjacent the central recess 95B of the yoke 95. This enables the flat surface 151A of the wall 151 to engage and act as an alignment surface for the keeper frame 1A. More specifically, when the housing part 21 of frame 1A is placed in the central recess 95B and the frame then maintained adjacent the surface 151A, the slots 21F and 21G in the housing part 21 become and are maintained in alignment with the fingers 98A and 99A of the probes 98 and 99. This facilitates entry of the fingers into the housing part through the aligned slots to release the keeper frame, as above-described.

In the detaching assembly 90 of FIGS. 14A and 14–16, the probes 98 and 99 have also been modified so that the probe ends 98B and 99B do not ride directly on the ramp walls 93 and 94. Instead these ends are squared and provided with rollers 152 and 153 which ride on the respective ramp walls. This facilitates sliding engagement of the probe ends and, thus, upward and downward movement of the yoke 95.

A further modification of the detaching assembly 90 illustrated in FIGS. 14A and 14–16 is the provision of a safety interlock assembly 160. The assembly 160 is adapted to prevent the yoke 95 from being pushed downwardly to bring the fingers 98A and 99A into the central recess 95B unless the housing part 21 of the keeper frame 1A has been first introduced into the recess.

Figure 16:
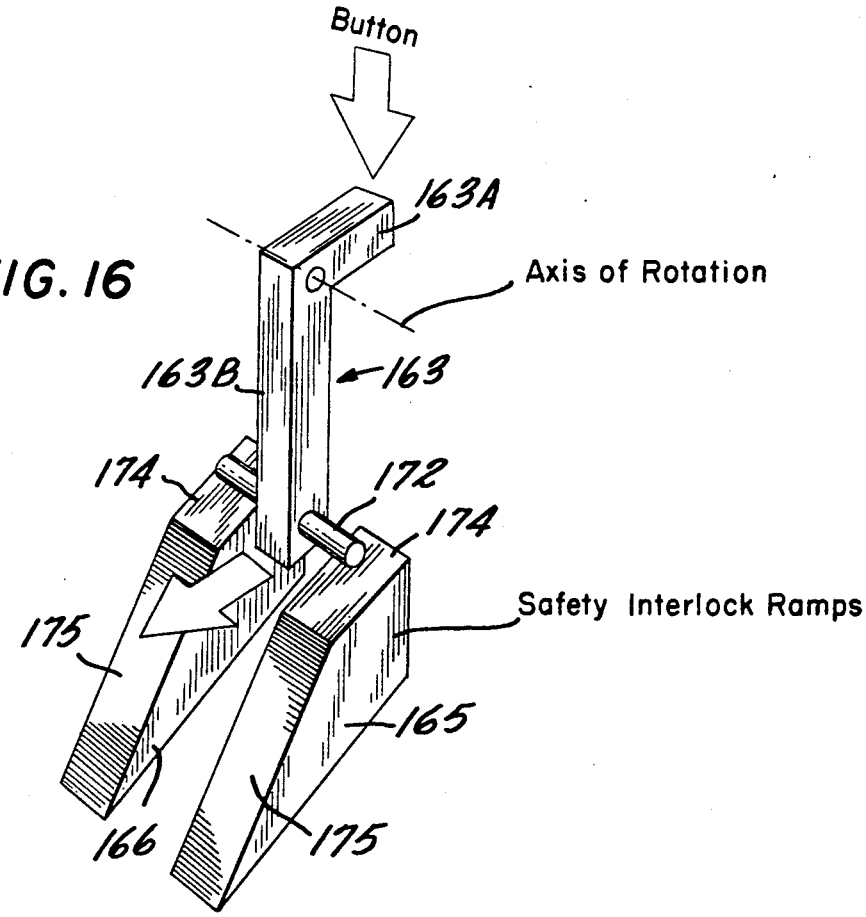

More particularly, the interlock assembly 160 comprises a pair of interlock arms 163 and 164 and corresponding pairs of spaced interlock abutments 165, 166 and 167, 168. The interlock arms 163 and 164 are each formed as inverted L-shaped members which are pivotally mounted to mounting parts 95E and 95F extending from the yoke surface 95A. This mounting is such that the upper arm parts 163A and 164A of the arms 163 and 164 extend into the central recess 95B of the yoke 95 transversely of the fingers 98A and 99A through openings 169 and 171. It is also such that transverse rods 172, 173 carried by the lower arm parts 163B and 164B are positioned to straddle the abutment pairs 165, 166 and 167, 168, respectively, while the corresponding lower arms are aligned with the space between the respective abutments. This is illustrated in FIG. 16 for the arm 163 and abutments 165 and 166.

Each of the abutments 165–168 includes a flat upper surface 174 which leads to a respective ramp or inclined surface 175. Each surface 175 ramps outwardly when proceeding downwardly and terminates at the base 92 which supports the corresponding abutment.

A spring 177 is connected between the lower arm parts 163B and 164B and is biased to force the lower arm parts inwardly. This inward biasing situates the arm parts so that the corresponding transverse rods 172, 173 lie directly above and closely adjacent to the flat surfaces 174 of the associated abutment pairs 165, 166 and 167, 168. This is illustrated by the position of lower arm part 164B and transverse rod 173 in FIG. 15.

With the lower arms 163B and 164B and transverse rods 172 and 173 in this position, yoke 95 is prevented from being moved downwardly any considerable distance. More particularly, when a downward force is applied to the yoke 95, the rods 172, 173 engage the respective flat surfaces 174 of the abutments 165, 166 and 167, 168, respectively. Downward movement of the yoke is thus limited to the small clearance distance between the rods and the flat surfaces. Accordingly, the yoke 95 cannot be moved downwardly sufficiently enough to cause the fingers 98A and 99A to be brought into the recess 95B.

Figure 15:
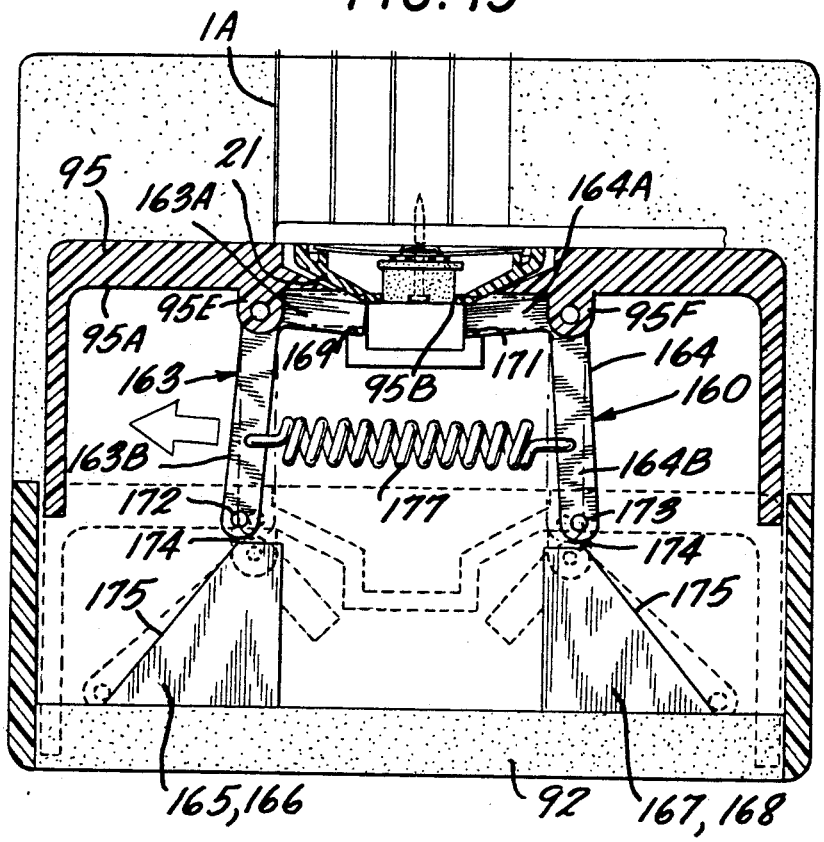

When the housing part 21 of a keeper 1A is now introduced into the recess 95B, the housing part 21 engages the ends of the upper arms 163A, 164A, pushing the arms downwardly (illustrated by upper arm 163A in FIG. 15). This causes the arms 163 and 164 and the lower arm parts 163B, 164B to pivot outwardly, expanding the spring 177 and moving the rods 172, 173 from over the flat surfaces 174 to over the ramp surfaces 175 of the associated abutments.

As the yoke 95 is now pushed downwardly, with the housing part 21 of the keeper 1A retained in the recess 95B, the pivoted arms 163 and 164 are now able to move downwardly as the rods 172, 173 follow the corresponding ramp surfaces 175 of the abutments. The final downward position of the yoke 95 and arms 163, 164 is illustrated in dotted line in FIG. 15. At this position, the yoke 95 has moved downwardly sufficiently for the fingers 98A and 99A to enter the housing part 21 and release the keeper 1A from the its package.

When the housing part 21 of keeper 1A is then removed from the yoke 95, the yoke is returned by the spring 97A to its upward position. This restores the arms 163 and 164 to their original position, where the interlock assembly 160 again blocks downward movement of the yoke 95, until a further keeper to be detached is inserted into the recess 95B.

It should be noted that the keeper 1 of the invention can be further adapted in accordance with the invention to include one or more tags or markers which can be detected by an appropriate electronic article surviellance system so as to prevent the unauthorized removal of the keeper from a given location. As shown, in FIG. 1, the frame 1A has embedded within it a first magnetic type marker 16 and a second RF type marker 17, although any other types of markers may also be used with the keeper.

An example of a magnetic marker which is useable is the acoustically resonant magnetic marker disclosed in U.S. Pat. Nos. 4,510,489, 4,510,490. Possible other magnetic markers are those disclosed in U.S. Pat. Nos. 4,686,516, 4,797,658 and possible RF markers might be thosed disclosed in U.S. Pat. Nos. 4,429,302, 4,356,477. The teachings of these patents are incorporated herein by reference.

Figure 19:
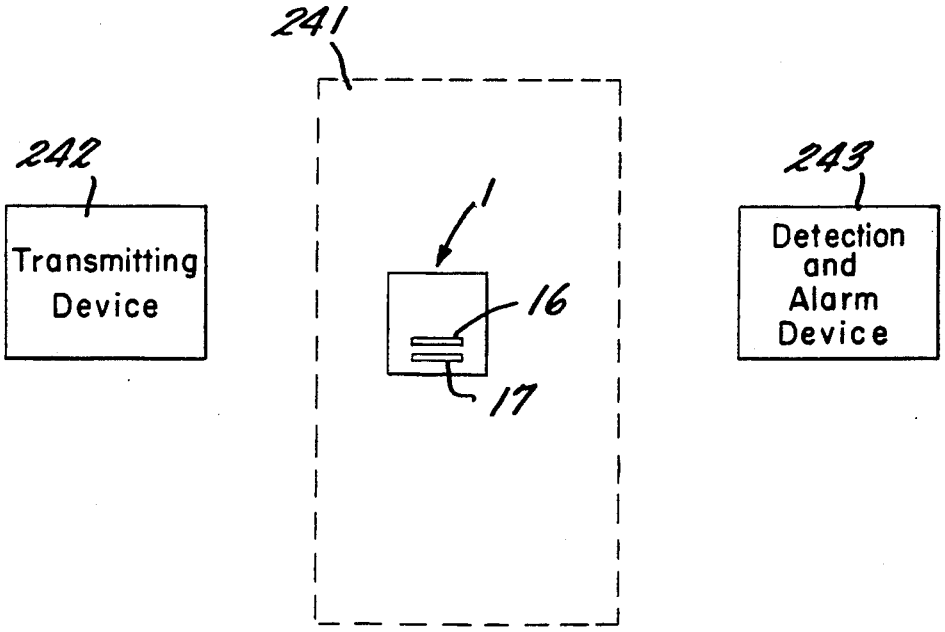
FIG. 19 shows an electronic article surveillance system for use in conjunction with the keeper of FIG. 1.

With the markers 16 and 17 incorporated in the keeper 1, detection of the keeper 1 in passing through an interrogation zone 241 (see FIG. 19) can be accomplished by transmitting interrogation signals via a transmitter device 242 into the zone and then detecting signals from the zone resulting from the interaction of the transmitted signals with the markers. A detection and alarm device 243 provides this detection and generates an alarm when the presence of a marker and, hence, a keeper 1 is detected.

As can be appreciated, the particular configurations used for the devices 242 and 243 will depend on the particular markers 16 and 17 employed in the keeper For markers of the types disclosed in the above-mentioned patents, devices of the types also disclosed in these patents can be used.

In all cases, it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

Thus, for example, while the keeper 1 has been illustrated for use with a packaged jewel box containing a compact disc, it could also be used for other articles such as, for example, video game or movie cartridges or audio cassettes.

What is claimed is:

1. A keeper for use with an outer package containing an article comprising:

a frame defining a volume for receiving the outer package, said frame having an opening through which said package can be introduced into said frame;

and slender rod-like piercing means supported on said frame for movement between a first position in which said piercing means is outside said volume and a second position in which said piercing means is within said volume, whereby said package can be introduced into said frame through said opening when said piercing means is in said first position and, thereafter, said package can be held in said frame by moving said piercing means to its second position to cause said piercing means to pierce and engage said package.

2. A keeper in accordance with claim 1 wherein:

said piercing means extends into said volume to an extent exceeding the wall thickness of the outer package, whereby said piercing means in moving into said second position after said package is first introduced into said frame pierces through the wall of said package into the package interior.

3. A keeper in accordance with claim 2 wherein:

said piercing means in said second position extends into said volume to a position in which it is in blocking relationship to the article in said package with respect to movement of said package out of said frame through said opening.

4. A keeper in accordance with claim 3 wherein:

said volume is of lesser extent than said package such that when said package is in said frame a first portion of said package is in said volume and a second portion of said package extends beyond said opening outside of said frame.

5. A keeper in accordance with claim 4 wherein:

said article is contained in a part of a second portion of the package, said part of said second portion of said package occupying a part of said volume when said package is in said frame;

and said piercing means in said second position lies above said part of said volume.

6. A keeper in accordance with claim 5 wherein:

said frame includes means for urging a wall of said package when said package is in said frame toward said slender rod-like piercing means, whereby said article in said package is maintained in said part of said second portion of said package.

7. A keeper in accordance with claim 1 wherein:

said article is a jewel box housing a compact disc;

and said outer package is one of fiberboard paperboard, cardboard or the like material.

8. A keeper in accordance with claim 1 wherein:

said piercing means includes means for creating an audible sound when said piercing means is brought to its first and/or positions.

9. A keeper in accordance with claim 1 wherein:

said piercing means includes an elongated pin having a pointed forward end.

10. A keeper in accordance with claim 1 wherein:

said piercing means includes means for locking said piercing means in said second position.

11. A keeper in accordance with claim 10 wherein:

said piercing means can be brought to said second position and locked by said locking means by direct hand actuation and the unlocking of said locking means to allow said piercing means to return to its first position requires use of a detaching assembly.

12. A keeper in accordance with claim 10 wherein:

said frame comprises:

opposing front and back wall sections; opposing side wall sections connecting corresponding lateral edges of said front and back wall sections; and a bottom wall section connecting the bottom edges of said front, back and side wall sections;

and said opening in said frame opposes said bottom wall section.

13. A keeper in accordance with claim 12 wherein:

said piercing means comprises: a housing affixed to one of said wall sections; a button mounted in said housing and movable toward and away from said one wall to bring said piercing means from said first to second position and from said second to first position; a pin having a pointed forward end, said pin being mounted to and movable with said button and having its pointed forward end in the direction of said one wall section, said pointed forward end of said pin being outside said volume in the first position of said piercing means and being brought into said volume when said button is moved toward said one wall section to place said piercing means in its second position.

14. A keeper in accordance with claim 13 wherein: said locking means comprises:

a spring clamp mounted in said housing between said one wall section and said button, said spring clamp having first and second jaws extending outwardly of the spring clamp body and then toward each other, said pin extending between said jaws and said spring clamp locking said jaws to grip said pin in the second position of said piercing means.

15. A keeper in accordance with claim 14 wherein: said pin has a groove and said jaws engage said groove when gripping said pin in the second position of said piercing means.

16. A keeper in accordance with claim 15 wherein: said jaws create an audible sound when being brought into engagement with said groove.

17. A keeper in accordance with claim 14 wherein: said housing includes first and second opposing slots facing the space between said jaws and said spring clamp body, said slots being adapted to receive flat, ramped fingers of a detaching assembly for entering said space to spread said jaws apart to release the grip of said jaws on said pin in the second position of said piercing means.

18. A keeper in accordance with claim 14 wherein: said one wall section is one of said side wall sections.

19. A keeper in accordance with claim 14 wherein: said piercing means further comprises: a conical spring encircling said pin and being of increasing diameter in extending between said button and the body of said spring clamp, said spring being compressed when said button is moved toward said one wall section to bring said piercing means to said second position and, upon release of the grip of said first and second jaws on said pin in said second position of said piercing means, said spring expanding to move said button and said pin away from said one wall section to bring said piercing means to said first position.

20. A keeper in accordance with claim 19 wherein: said one wall section is one of said side wall sections.

21. A keeper in accordance with claim 19 wherein: said spring in bringing said piercing means to said first position causes said button to engage said housing with sufficient force to create an audible sound.

22. A keeper in accordance with claim 13 wherein: said one wall section has an aperture through which said pin passes, the pointed end of said pin residing in said aperture in said first position of said piercing means and passing out of said aperture into said volume when said piercing means is brought from said first to second positions.

23. A keeper in accordance with claim 13 wherein: the wall section of said frame opposing said one wall section includes a projection which extends toward said one wall section.

24. A keeper in accordance with claim 23 wherein: said projection is positioned to oppose said pin.

25. A keeper in accordance with claim 10 wherein: said locking means comprises: a spring clamp mounted to said keeper and having first and second jaws extending outwardly of the spring clamp body and toward each other, said piercing means extending between said jaws and said spring clamp locking said jaws to grip said piercing means in the second position of said piercing means.

26. A keeper in accordance with claim 1 further comprising:

a detectable marker affixed to said keeper.

27. A keeper in accordance with claim 26 wherein: said detectable marker is embedded in said keeper.

28. A keeper in accordance with claim 26 wherein: said detectable marker comprises one of a magentic marker and an RF marker.

29. A keeper in accordance with claim 27 wherein: said magnetic marker is an acoustially resonant magnetic marker.

30. A keeper in accordance with claim 1 wherein: said frame includes means for urging a wall of said package when said package is in said frame toward said slender rod-like piercing means.

31. A keeper in accordance with claim 1 wherein: said article is one of a movie or video game cartridge or an audio cassette.

32. In combination:

a keeper for use with an outer package containing an article comprising: a frame defining a volume for receiving the outer package, said frame having an opening through which said package can be introduced into said frame; and slender rod-like piercing means supported on said frame for movement between a first position in which said piercing means is outside said volume and a second position in which said piercing means is within said volume, whereby said package can be introduced into said frame through said opening when said piercing means is in said first position and, thereafter, said package can be held in said frame by moving said piercing means to its second position to cause said piercing means to pierce and engage said package, said piercing means further including means for locking said piercing means in said second position;

and a detaching means for unlocking said locking means to allow said piercing means to move from said second to first position.

33. The combination of claim 32 wherein: said detaching means is separate from said keeper.

34. The combination of claim 32 wherein: said locking means comprises: a spring clamp mounted o said keeper and having first and second jaws extending outwardly of the spring clamp body and toward each other, said piercing means extending between said jaws and said spring clamp locking said jaws to grip said piercing means in the second position of said piercing means;

and said detaching means comprises means for spreading said first and second jaws apart in the second position of said piercing means to release the grip of said first and second jaws on said piercing means.

35. The combination of claim 34 wherein:

said means for spreading comprises: first and second probes translatable relative to the space between said first and second jaws and the body of said spring clamp, said probes having ramped fingers in opposing relationship to each other and movable toward each other to enter said space and separate said first and second jaws and movable away from each other to move out of said space.

36. The combination of claim 35 wherein:

said detaching means includes alignment means for engaging with said frame so as to cause said space between said jaws to be aligned with said first and second probes.

37. The combination of claim 36 wherein:

said alignment means includes an upstanding wall on said detaching means.

38. A detaching device for use in detaching a keeper from an outer package containing an article comprising:

first and second probes having first ends in facing relationship, said probes being mounted to said device to translate linearly and each of said first ends of said probes including a ramped surface;

and means for linearly translating said probes to move said first ends toward each other and away from each other.

39. A device in accordance with claim 38 wherein:

said first ends of said probes are formed as ramped fingers.

40. A device in accordance with claim 38 wherein:

said means for translating includes first and second spaced surfaces disposed in facing relationship, said first and second surfaces being in contact with respective second ends of said first and second probes, and said means for translating causing relative movement between said second probe ends and said first and second surfaces.

41. A device in accordance with claim 40 wherein:

said first and second surfaces are ramped surfaces.

42. A device in accordance with claim 40 wherein:

said device further comprises: a bottom wall; first and second side walls extending upwardly from said bottom wall; and a mounting member disposed between said first and second side walls and extending upwardly from said bottom wall;

said first and second surfaces are formed as the facing surfaces of said first and second side walls and are ramped away from each other when proceeding in the upward direction;

and said means for translating further includes a yoke extending between said first and second side walls and mounted on said mounting member for movement toward and away from said bottom wall, said yoke having a recessed area and first and second mounting sections on opposite sides of said recessed area and to which said first and second probes are translationally mounted with the second ends of said probes in contact with said first and second surfaces, whereby downward movement of said yoke on said mounting member causes said first and second surfaces to urge said probe second ends toward each other and thereby cause said probe first ends to move toward each other and into the recessed area.

43. A device in accordance with claim 42 further comprising:

a first spring surrounding said mounting member and extending between the bottom of said yoke and said bottom wall.

44. A device in accordance with claim 43 wherein:

said first section of said yoke is slidably mounted to said mounting member; and said device further includes a second mounting member to which said second section of said yoke is slidably mounted and a second spring encircling said second mounting member and extending between the bottom of said yoke and said bottom wall.

45. A device in accordance with claim 42 wherein:

said means for translating further comprises first and second springs attached to the respective second ends of said first and second probes for urging said second ends against said respective first and second surfaces.

46. A device in accordance with claim 42 wherein:

said device further comprises: a top wall extending from said first and second side walls and having an opening over said recessed area of said yoke, said top wall along a part of said opening having an upstanding wall portion.

47. A device in accordance with claim 46 wherein:

said upstanding wall portion has a flat surface facing said opening.

48. A device in accordance with claim 42 further comprising:

interlock means for selectively allowing downward movement of said yoke.

49. A device in accordance with claim 48 wherein:

said interlock means comprises: means communicating with said recessed area;

and said interlock means allows downward movement of said yoke when said communicating means is engaged.

50. A device in accordance with claim 48 wherein:

said interlock means comprises: first and second spaced interlock abutments mounted to said bottom wall and each having a flat upper surface which leads into a ramped surface; and an interlock arm pivotally mounted to said yoke and having an upper arm member extending into said recessed area and a lower arm member extending downwardly to a point adjacent to the space between said abutments, said lower arm member carrying a transverse bar extending in opposite directions and bridging said first and second abutments; and biasing means which, when the part of said upper arm extending into said recessed area is disengaged, biases said interlock arm such that said lower arm member and said transverse bar are over said flat surface of said first and second abutments preventing downward movement of said yoke and which, when said part of said upper arm member is engaged, biases said interlock arm such that said lower arm member and transverse bar are over said ramped surface of said first and second abutment allowing downward movement of said yoke.

51. A device in accordance with claim 40 wherein:

said first and second surfaces are curved camming surfaces.

52. A device in accordance with claim 39 further comprising:

first and second members pivotally mounted to each other at a pivot point, said members at corresponding first ends being formed as facing cup-shaped sections whose inner surfaces form said first and second surfaces; a hollow housing opening at its top and situated between said cup-shaped sections, said housing being fixedly mounted to said first and second members at said pivot point; first and second support sections attached to and opening into said housing, said first support section being situated between said first cup-shaped section and said housing and said second support section being situated between said second cup-shaped section and said housing; and said first and second probes being translationally mounted to said first and second support sections with the second ends of said probes in contact with the respective first and second surfaces, whereby pivoting of said first and second members about said pivot point causes upward and inward movement of said cup-shaped sections and said first and second surfaces urging said second ends of said probes toward each other and thereby causing said first ends of said probes to move toward each other and into said housing.

53. A device in accordance with claim 40 wherein:

said means for translating further includes first and second springs mounted to said second ends of said probes for urging said probes against said first and second surfaces.

54. In combination:

a keeper for use with an outer package containing an article comprising: a frame defining a volume for receiving the outer package, said frame having an opening through which said package can be introduced into said frame; slender rod-like piercing means supported on said frame for movement between a first position in which said piercing means is outside said volume and a second position in which said piercing means is within said volume, whereby said package can be introduced into said frame through said opening when said piercing means is in said first position and, thereafter, said package can be held in said frame by moving said piercing means to its second position to cause said piercing means to pierce and engage said package;

and a detectable marker affixed to said frame; and means for detecting said marker.

55. The combination of claim 54 wherein:

said detecting means comprises: means for transmitting a signal into an interrogation zone; and means for sensing a signal from said interrogation zone resulting from interaction of said transmitted signal with the marker affixed to said keeper.

56. The combination of claim 55 wherein:

said marker is a magnetic marker and said transmitted and sensed signals are magnetic signals.

57. The combination of claim 56 wherein:

said marker is an acoustically resonant magnetic marker.

58. The combination of claim 55 wherein:

said marker is an RF marker;

and said transmitted and sensed signals are RF signals.

59. The combination of claim 55 wherein:

said marker is embedded in said frame.

60. A method for use with a frame and an outer package, the frame defining a volume for receiving the package, the method comprising:

introducing said outer package into said volume of said frame through an opening in said frame;

and moving a slender rod-like piercing means supported on said frame from a first position in which said piercing means is outside said volume to a second position in which said piercing means is within said volume to cause said piercing means to pierce and engage said package.

61. A method in accordance with claim 60 wherein:

said moving step moves said piercing means into said volume to an extent exceeding the wall thickness of the outer package, whereby said piercing means pierces through the wall of said package into the package interior.

62. A method in accordance with claim 61 wherein:

said moving step moves said piercing means into said volume to a position in which it is in blocking relationship to the article in said package with respect to movement of said package out of said frame through said opening.

63. A method in accordance with claim 62 wherein:

said piercing means in said position is above said article.

64. A method in accordance with claim 60 wherein:

said article is a jewel box housing a compact disc;

and said outer package is one of fiberboard paperboard, cardboard or the like material.

65. A method in accordance with claim 60 wherein:

said moving step includes creating an audible sound as said piercing means pierces and engages said package.

66. A method in accordance with claim 60 wherein:

said piercing means includes an elongated pin having a pointed forward end.

67. A method in accordance with claim 60 wherein:

said frame comprises:

opposing front and back wall sections; opposing side wall sections connecting corresponding lateral edges of said front and back wall sections; and a bottom wall section connecting the bottom edges of said front, back and side wall sections;

and said opening in said frame opposes said bottom wall section.

68. A method in accordance with claim 67 wherein:

said piercing means comprises a pin having a pointed forward end.

69. A method in accordance with claim 60 wherein:

said moving step includes locking said piercing means in said second position;

and said method further includes; unlocking said piercing means; and moving said piercing means from said second to first position to disengage said piercing means from said package.

70. A method in accordance with claim 69 wherein:

said locking step comprises closing the first and second jaws of a spring clamp on said piercing means.

71. A method in accordance with claim 70 further comprising:

said unlocking step includes opening the jaws of said spring clamp to release said piercing means.

72. A method in accordance with claim 71 wherein:

said further moving step includes creating an audible sound.

73. A method in accordance with claim 60 further comprising:

further moving said piercing means from said second to first position to disengage said piercing means from said package.

74. A method in accordance with claim 60 further comprising:

detecting a marker affixed to said keeper.

75. A method in accordance with claim 60 wherein:

said article is one of a movie or video game cartridge or an audio cassette.

* * * * *

UNITED STATES PATENT AND TRADEMARK OFFICE

CERTIFICATE OF CORRECTION

PATENT NO. : 5,031,756

DATED : July 16, 1991

INVENTOR(S) : Jon D. Buzzard, et al.

It is certified that error appears in the above-identified patent and that said Letters Patent is hereby corrected as shown below:

Col. 2, lines 51, 56, 58. Change "pictorally" to -- pictorially --

Col. 2,line 63. Change "Various" to -- various -- and "Of" to -- of --

Col. 5, line 34. Change "inner most" to -- innermost --

Col. 6, line 51. After "tion" insert -- . --

Col. 6, line 68. Change "plyer-like" to -- plier-like --

Col. 10, line 46. After "or" insert -- second --

Col. 12, line 23. Change "acoustially" to -- acoustically --

Col. 16, line 20. After "fiberboard" insert -- , --

Signed and Sealed this

Twelfth Day of January, 1993

*Attest:*

*Attesting Officer*

DOUGLAS B. COMER

*Acting Commissioner of Patents and Trademarks*